US009478915B2

(12) United States Patent
Guo et al.

(10) Patent No.: US 9,478,915 B2
(45) Date of Patent: Oct. 25, 2016

(54) ELECTRICAL CONNECTOR HAVING POWER TERMINALS IN AN UPPER ROW IN CONTACT WITH THOSE IN A LOWER ROW

(71) Applicant: FOXCONN INTERCONNECT TECHNOLOGY LIMITED, Grand Cayman (KY)

(72) Inventors: Bin Guo, Kunshan (CN); Chun-Ming Yu, Kunshan (CN); Ke-Hao Chen, New Taipei (TW); Hao Zhou, Kunshan (CN); Xiao-Qin Zheng, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 14/924,661

(22) Filed: Oct. 27, 2015

(65) Prior Publication Data

US 2016/0118750 A1 Apr. 28, 2016

(30) Foreign Application Priority Data

Oct. 27, 2014 (CN) ..... 2014 2 0623795 U

(51) Int. Cl.

| | |
|---|---|
| ***H01R 12/00*** | (2006.01) |
| ***H01R 13/6585*** | (2011.01) |
| ***H01R 12/70*** | (2011.01) |
| ***H01R 12/58*** | (2011.01) |

(52) U.S. Cl.

CPC ..... *H01R 13/6585* (2013.01); *H01R 12/585* (2013.01); *H01R 12/7005* (2013.01)

(58) Field of Classification Search

CPC ..... H01R 9/091; H01R 12/00; H01R 12/57; H01R 12/585; H01R 12/70; H01R 12/7005; H01R 13/6585; H01R 23/725; H01R 23/7073

USPC ..... 439/78

See application file for complete search history.

(56) References Cited

U.S. PATENT DOCUMENTS

| | | | | |
|---|---|---|---|---|
| 2013/0040501 | A1* | 2/2013 | Peng | H05K 1/0248 439/660 |
| 2015/0270661 | A1* | 9/2015 | Kao | H01R 13/5202 439/271 |
| 2015/0303610 | A1* | 10/2015 | Hou | H01R 24/62 439/660 |
| 2016/0118752 | A1* | 4/2016 | Guo | H01R 13/6594 439/78 |
| 2016/0181743 | A1* | 6/2016 | Tsai | H01R 24/60 439/587 |
| 2016/0181744 | A1* | 6/2016 | Kao | H01R 24/60 439/676 |

FOREIGN PATENT DOCUMENTS

| | | |
|---|---|---|
| TW | M471703 | 2/2014 |

* cited by examiner

*Primary Examiner* — Chandrika Prasad
(74) *Attorney, Agent, or Firm* — Wei Te Chung; Ming Chieh Chang

(57) ABSTRACT

An electrical connector includes a terminal module and a plurality of terminals retained in the terminal module. The plurality of terminals are divided into an upper row and a lower row. Each of the terminals has a contacting portion contacting with a complementary connector. Each row of the terminals has a power terminal and a differential pair. The contacting portion of the power terminal in the upper row and the corresponding contacting portion of the power terminal in the lower row mechanically contact with each other to form parallel electrical paths.

17 Claims, 8 Drawing Sheets

ELECTRICAL CONNECTOR HAVING POWER TERMINALS IN AN UPPER ROW IN CONTACT WITH THOSE IN A LOWER ROW

BACKGROUND OF THE INVENTION

1. Field of the Invention

The present invention relates to an electrical connector, and particularly to an electrical connector having power terminals secured therein. The application relates to the copending application having the same filing date, the same applicant and the common inventors with the instant application, and titled "ELECTRICAL CONNECTOR WITH UPPER AND LOWER GROUNDING TERMINALS CONNECTED WITH EACH OTHER".

2. Description of Related Art

USB standards association published a new type of connector called USB Type-C connector in Aug. 11, 2014. The USB Type-C connector is improved on the basis of USB 2.0 and USB 3.0. The mating cavity of the USB Type C receptacle is symmetric so as to provide an interface into which a USB Type C plug may insert in two opposite orientation. The USB Type-C connector may meet the requirement of 10 Gbit/s transmission rate same as USB 3.1. According to specification published by the association, the USB Type-C receptacle connector has an insulative housing and two opposite rows of upper terminals and lower terminals disposed in the insulative housing. The upper terminals have at least a power terminal, differential pairs including TX and RX Pairs. The upper terminals and the lower terminals are separated from each other without any contacting therebetween. In the process of development, we find that serious influence will be caused between the tow signal terminals in each differential pair during signal transmission.

In view of the above, an improved electrical connector is desired to overcome the problems mentioned above.

SUMMARY OF THE INVENTION

Accordingly, an object of the present invention is to provide an electrical connector, the resonance point of the frequency domain of the electrical connector and the interference between the signal terminals in each differential pair are improved.

According to one aspect of the present disclosure, an electrical connector mating with a complementary connector comprises a terminal module and a plurality of terminals retained in the terminal module. The plurality of terminals are divided into an upper row and a lower row. Each of the terminals has a contacting portion contacting with a complementary connector. Each row of the terminals has a power terminal and a differential pair. The contacting portion of the power terminal in the upper row and the corresponding contacting portion of the power terminal in the lower row mechanically contact with each other to form parallel electrical paths.

Other objects, advantages and novel features of the disclosure will become more apparent from the following detailed description when taken in conjunction with the accompanying drawings.

DETAILED DESCRIPTION OF THE INVENTION

Reference will now be made to the drawings to describe a preferred embodiment of the present disclosure in detail.

Figure 1:
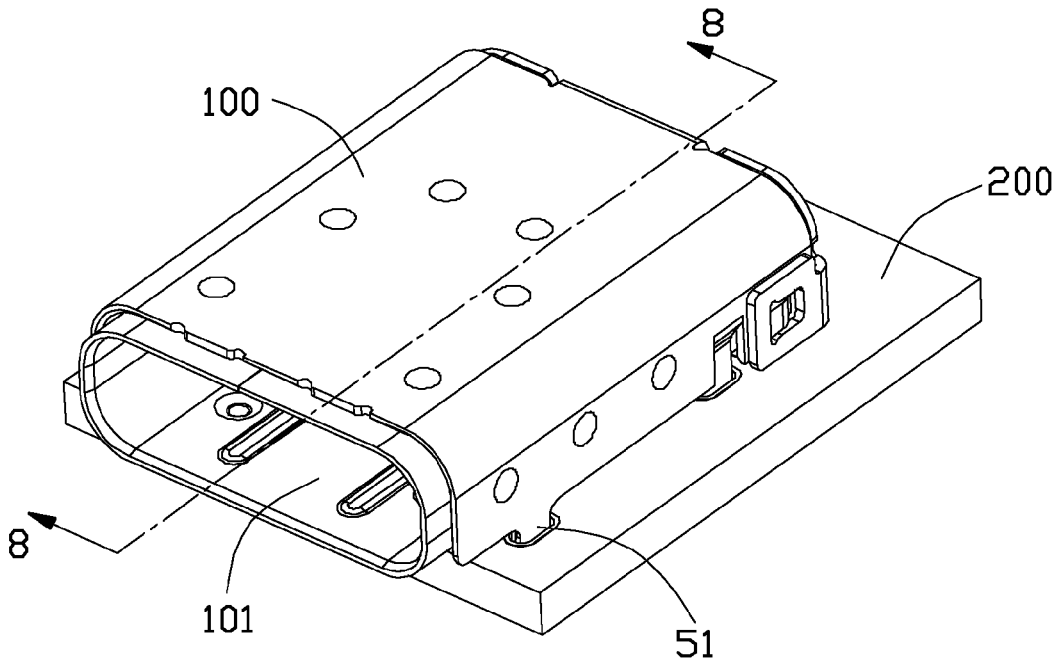
FIG. 1 is perspective view of an electrical connector mounted on a printed circuit board.
Figure 2:
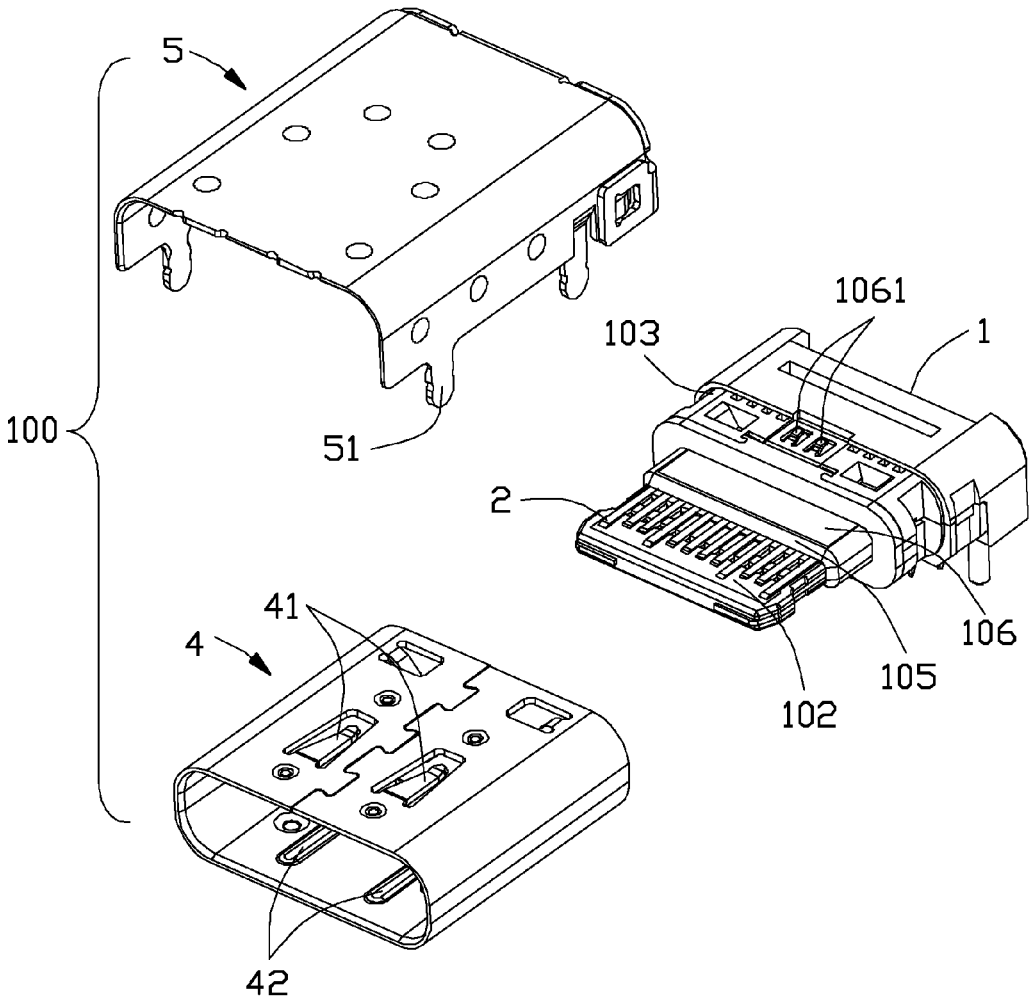
FIG. 2 is a partly exploded perspective view of the electrical connector shown in FIG. 1.
Figure 4:
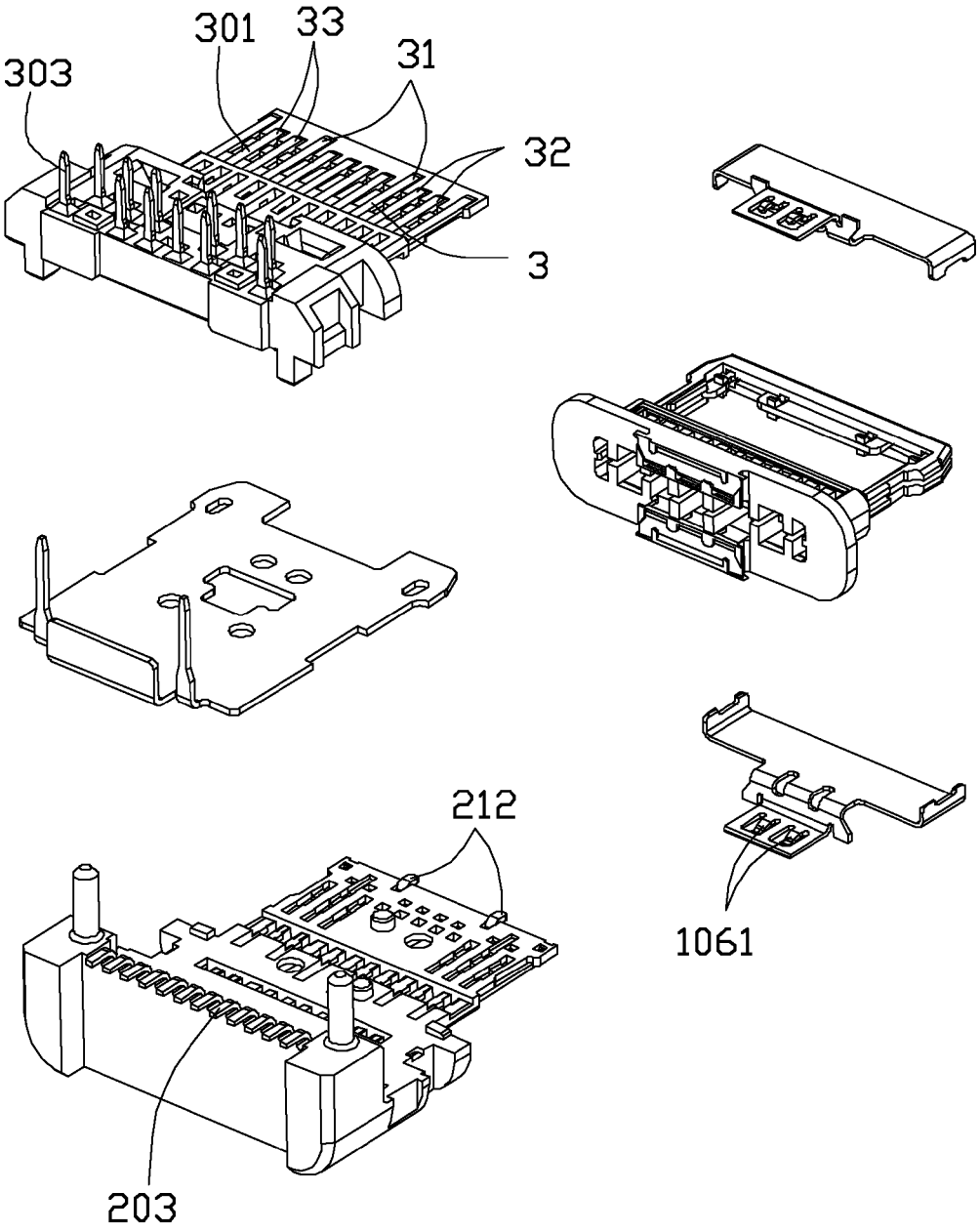
FIG. 4 is another perspective view of which shown in FIG. 3.

Referring to FIGS. 1-2 and 4, the present invention provided with an electrical connector 100 mounted on a printed circuit board 200. The electrical connector 100 may mate with a complementary connector (not labeled). The electrical connector 100 has a terminal module 1, a row of upper terminals 2 and a row of lower terminals 3 retained in the terminal module 1, a metallic shell 4 surrounding the terminal module 1, and a metallic cover 5 retained on the metallic shell 4.

Figure 5:
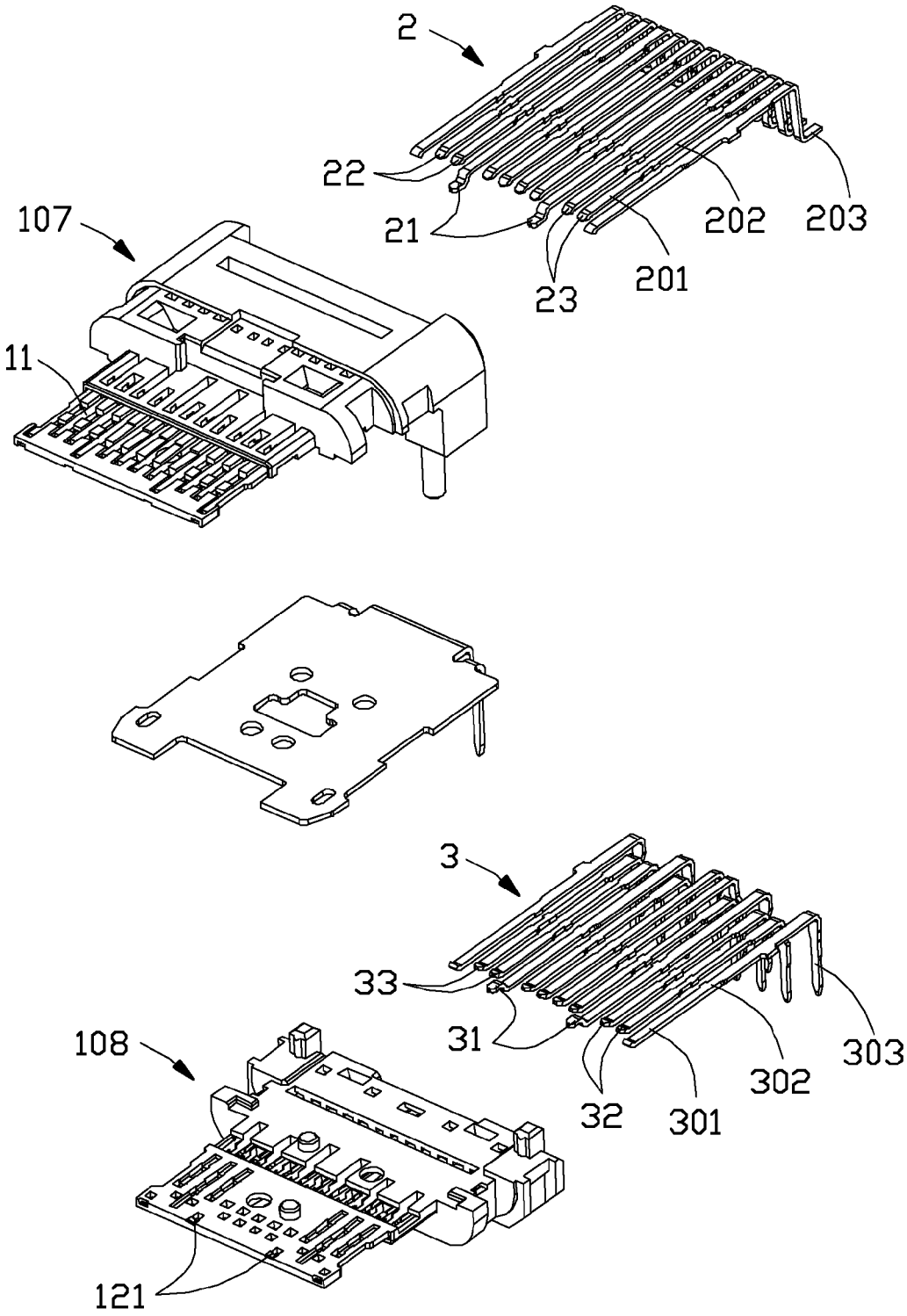
FIG. 5 is a part exploded perspective view of the electrical connector shown in FIG. 1.
Figure 7:
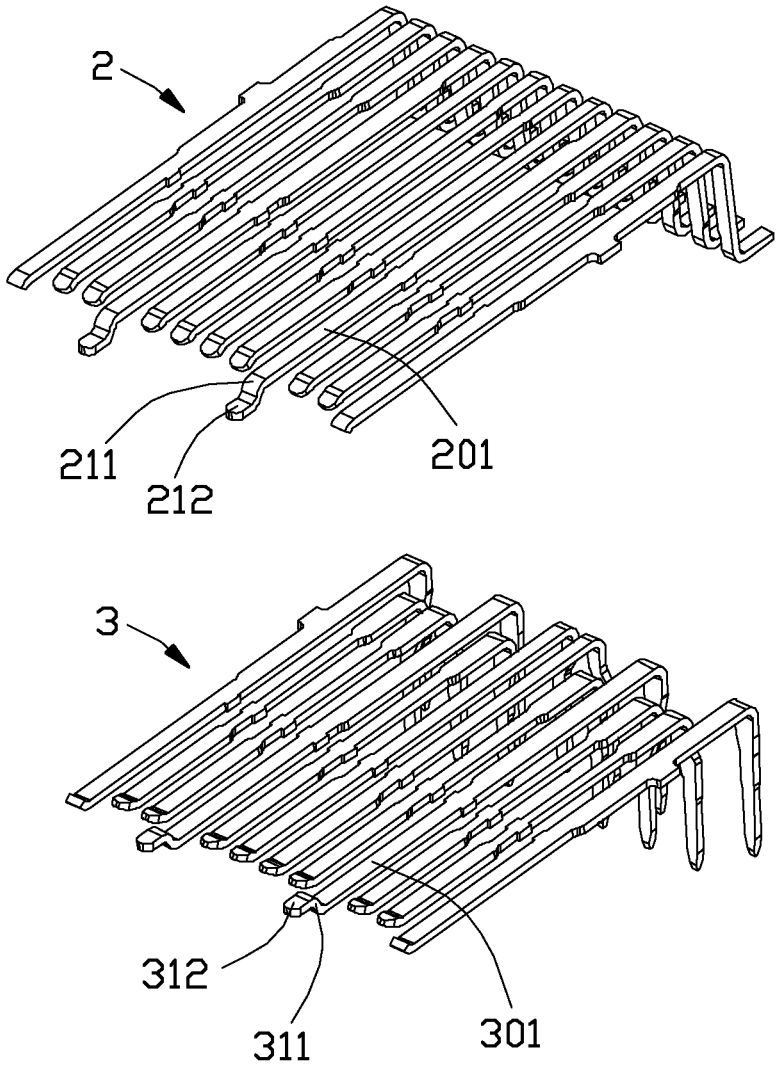
FIG. 7 is a perspective view of upper terminals and lower terminals of the electrical connector shown in FIG. 1.
Figure 8:
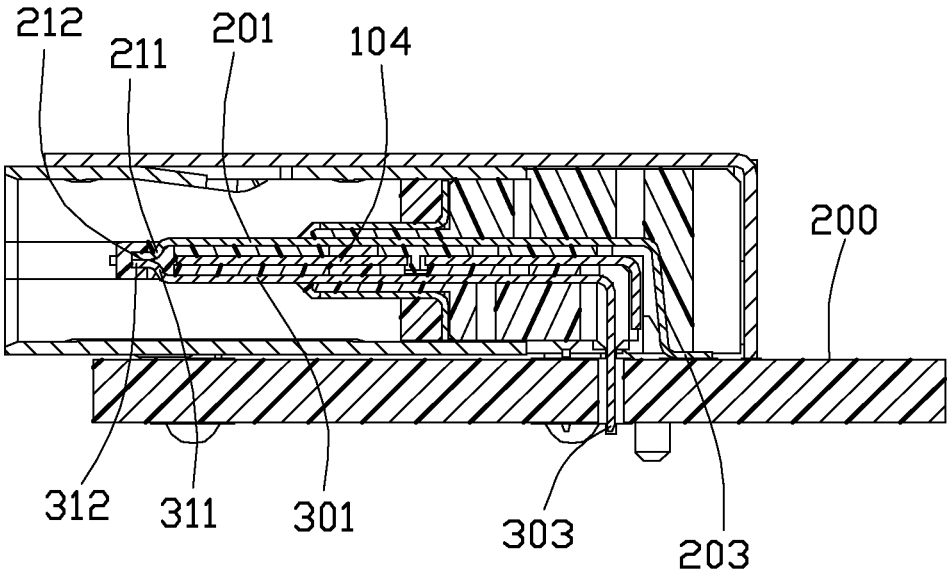
FIG. 8 is a sectional perspective view of the electrical connector along line 8-8 shown in FIG. 1.

Referring to FIGS. 3-6, the upper terminals 2 each has a contacting portion 201 electrically connecting with a complementary connector, a middle portion 202 and a soldering leg 203 (shown in FIG. 5). The lower terminals 3 each has a contacting portion 301 electrically connecting with the complementary connector, a middle portion 302 and a soldering leg 303 (shown in FIG. 5). The upper terminals 2 have at least a power terminal 21, a differential pair 22 used for transmitting date at high speed, and a differential pair 23 used for receiving date at high speed. The differential pairs 22, 23 are adjacent to the power terminal 21. The lower terminals 3 have at least a power terminal 31, a differential pair 32 used for transmitting date at high speed, and a differential pair 33 used for receiving date at high speed. The differential pairs 32, 33 are adjacent to the power terminal 31. The upper terminals 2 have at least a grounding terminal (not labeled), the lower terminals 3 also have at least a grounding terminal (not labeled). The power terminal 21 in the upper row and the power terminal 31 in the lower row mechanically and electrically connect with each other so as to form parallel electrical paths. In the present embodiment, the upper terminals 2 have two power terminals 21 apart from each other, the differential pair 22 used for transmitting date at high speed is adjacent to one power terminal 21 and the differential pair 23 used for receiving date at high speed is adjacent to another power terminal 21. The lower terminals 3 also have two power terminals 31 apart from each other, the differential pair 32 used for transmitting date at high speed is adjacent to one power terminal 31 and the differential pair 33 used for receiving date at high speed is adjacent to another power terminal 31. More specifically, the soldering portions 203, 303 of the power terminals 21, 31 are retained on the printed circuit board 200 and electrically connect with power points (not labeled) of the printed circuit board 200. The power soldering points on the printed circuit board 200 are normally regarded as the power points. Free ends of the contacting portions 201, 301 of the corresponding power terminals 21, 31 of the upper and lower terminals 2, 3 mechanically contact with each other. Combined with FIG. 7, front free end of the contacting portion 201 of the power terminal 21 of the upper terminals 2 initially bends downwardly at a certain angle to form a first bending portion 211, and then forwardly and horizontally extends to form a first extending portion 212. Corresponding free end of the contacting portion 301 of the power terminal 31 of the lower terminals 3 initially bends upwardly at a certain angle to form a second bending portion 311, and then forwardly and horizontally extends to form a second extending portion 312. Combined with FIG. 8, the first extending portion 212 and the second extending portion 312 contact with each other.

Figure 6:
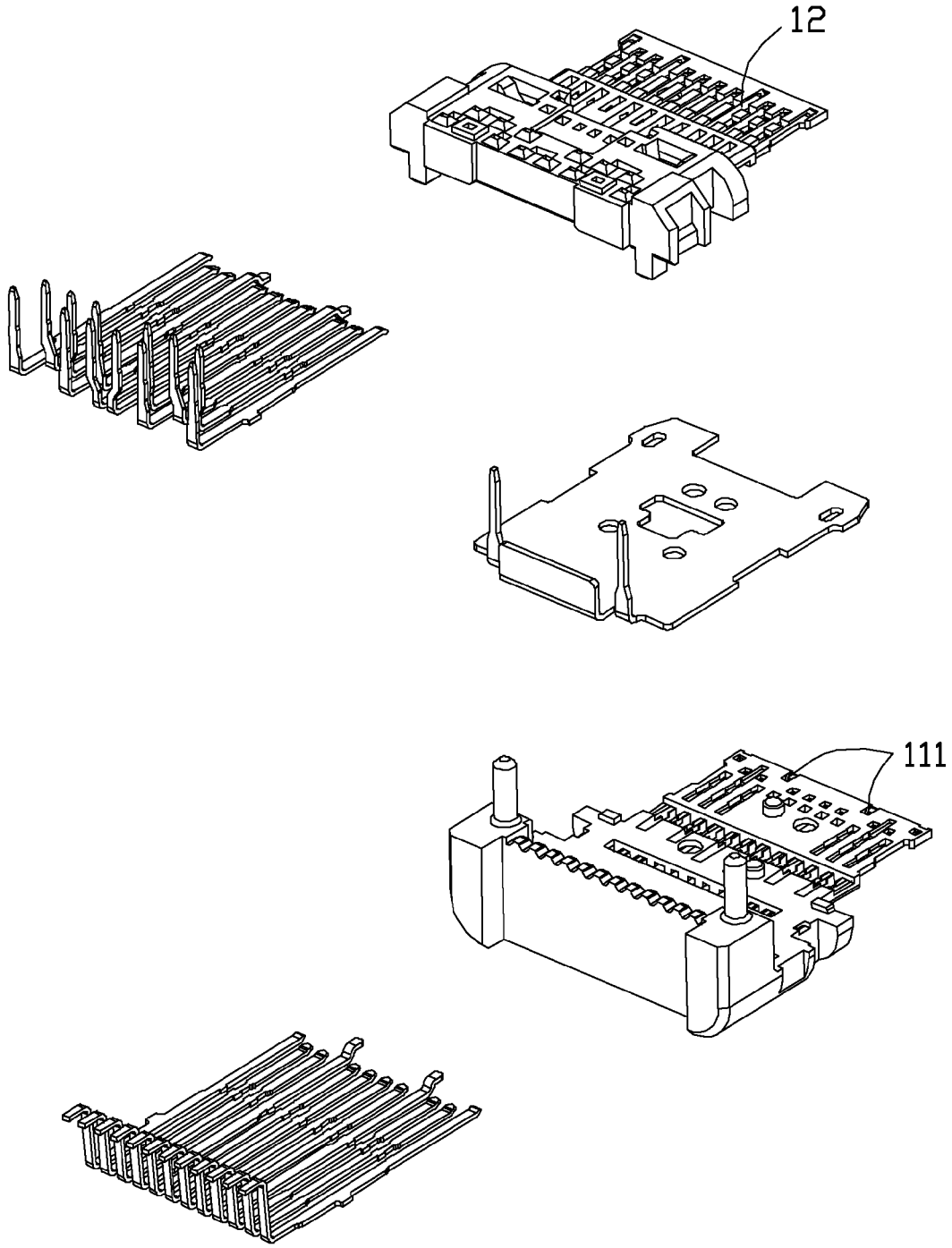
FIG. 6 is another perspective view of which shown in FIG. 5.

Referring to FIGS. 5-6, the terminal module 1 has a plurality of upper slots 11 and lower slots 12. The contacting portions 201 are received in the upper slots 11, and the contacting portions 301 are received in the lower slots 12. The slot 11 has a hole 111 recessed downwardly from an inner surface corresponding to the free end of the contacting portion 201 of the power terminal 21, the slot 12 has a hole 121 recessed upwardly from an inner surface corresponding to the free end of the contacting portion 301 of the power terminal 31. The holes 111, 121 are communicating with each other. Combined with FIG. 8, the first bending portion 211 and the second bending portion 311 are respectively inserted into the corresponding holes 111, 121 so as to make the first extending portion 212 and the second extending portion 312 contacting with each other.

Figure 3:
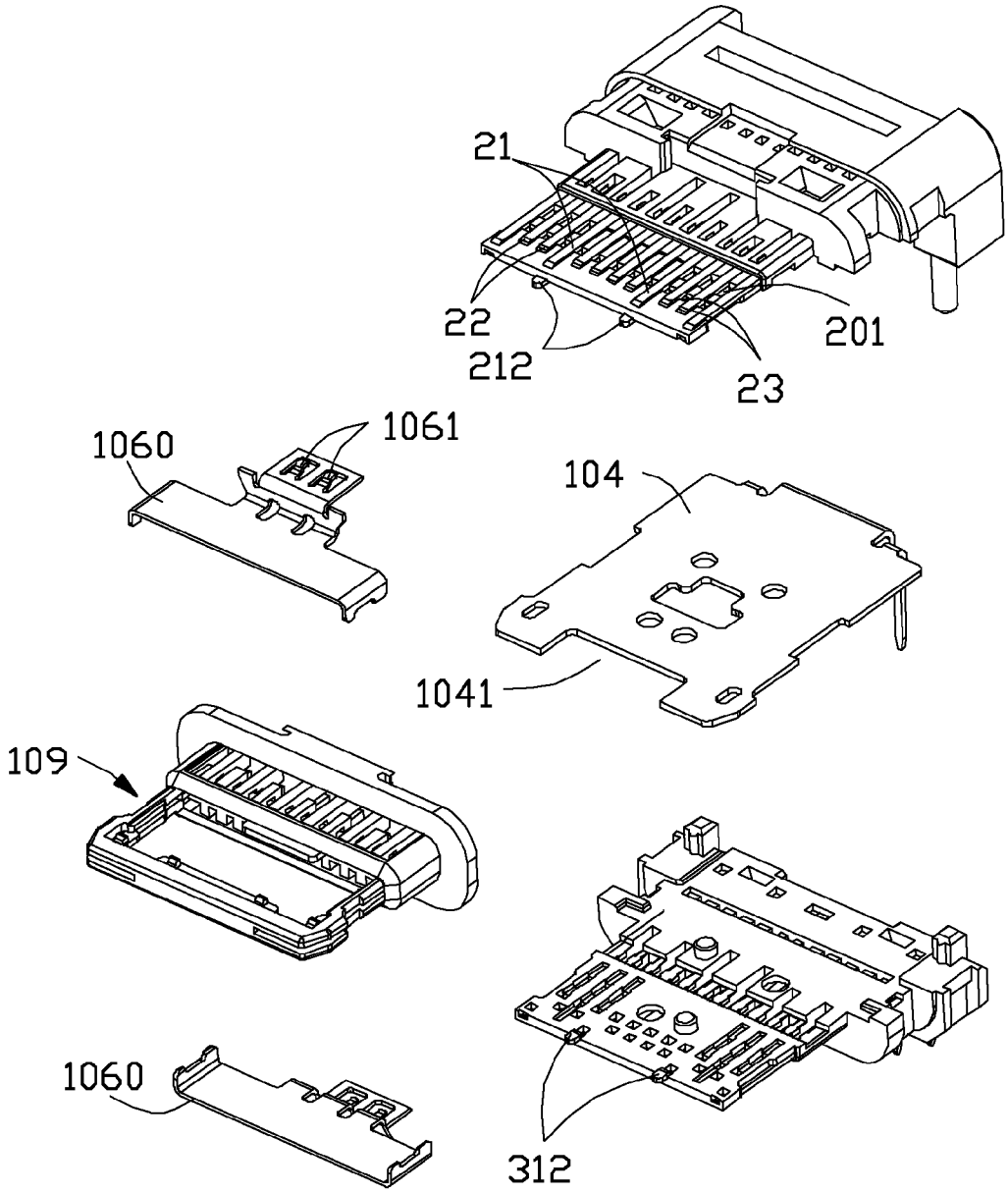
FIG. 3 is an exploded perspective view of a terminal module shown in FIG. 2.

Referring to FIGS. 2-4, as a preferred embodiment of the present invention, the terminal module 1 has a base portion 103 located at a rear side thereof and a mating portion 102 at a front side thereof. The mating portion 102 has two opposite mating faces. The slots 11, 12 respectively disposed at two mating faces aforementioned. The electrical connector 100 has a shielding plate 104 retained in the mating portion 102 and being sandwiched between the two slots 11, 12. The shielding plate 104 has an notch 1041 corresponding to the holes 111, 121 so as to form a room in which the first extending portion 212 and the second extending portion 312 dispose and mechanically contact with each other. The mating portion 102 has a stepping portion 105 adjacent to the base portion 103. The base portion 103 and the stepping portion 105 are made from plastic material. The middle portions 202, 302 of the terminals 2, 3 are embedded in the stepping portion 105, the soldering portions 203, 303 extends out of the base portion 103 and are soldered on the printed circuit board 200. The electrical connector 100 has two grounding members 106 disposed at two opposite faces of the stepping portion 105. The two grounding members 106 each has a grounding portion 1060 attached on a surface of the base portion 103. The grounding portion 1060 has an elastic contacting plate 1061 elastically abutting on the metallic shell 4. Referring to FIGS. 3-6, the terminal module 1 has an upper insulator 107, a lower insulator 108 and an over-molding portion 109 corresponding with the upper insulator 107 and the lower insulator 108. The slots 11 are disposed in a front area of the upper insulator 107, the slots 12 are disposed in a front area of the lower insulator 108. The shielding plate 104 is sandwiched between the upper insulator 107 and the lower insulator 108. The row of the upper terminals 2 are embedded in the upper insulator 107, the row of the lower terminals 3 are embedded in the lower insulator 108. The stepping portion 105 formed by the upper insulator 107 and the lower insulator 108 is surrounded by the grounding members 106. Notably, the two grounding members 106 may be formed as one unite in other embodiments.

Referring to FIGS. 1-2, the metallic shell 4 is retained on an outer surface of the base portion 103 and surrounds the mating portion 102 and the stepping portion 105 to form a mating cavity 101. The metallic shell 4 has an upper wall having two pressing portions 41 extending into the mating cavity 101 from a front area of the upper wall. The metallic shell 4 has a lower wall having two ribs 42 protruding into the mating cavity 101. The rib 42 each extends along the mating direction. The metallic cover 5 is retained on the metallic shell 4 by laser welding technology. The metallic cover 5 has a plurality of mounting legs 51 extending downwardly at two sides thereof to be soldered on the printed circuit board 200.

The first bending portion 211 of the power terminal 21 is inserted into the hole 111, the second bending portion 311 of the power terminal 31 is inserted into the hole 121, the hole 111 and the hole 121 are aligned with each other and communicate with each other to form a room in which the first extending portion 212 and the second extending portion 312 dispose and mechanically contact with each other, thereby the corresponding power terminals 21, 31 are parallel electrical paths. Due to the improved structure, the resonance point of the frequency domain of the electrical connector and the interference between signal terminals in each differential pair are improved. The electrical connector 100 of the present invention may meet the provision of the USB Type-C specification.

In other embodiments, the shape and the size of the holes 111, 121 may be changed adaptively. The notch 1041 may be closed in the front.

While preferred embodiment in accordance with the present disclosure has been shown and described, equivalent modifications and changes known to persons skilled in the art according to the spirit of the present disclosure are considered within the scope of the present disclosure as defined in the appended claims.

What is claimed is:

1. An electrical connector for mating with a complementary connector, comprising:

a terminal module;

a plurality of terminals retained in the terminal module, the plurality of terminals being divided into an upper row and a lower row, each of the terminals having a contacting portion contacting with a complementary connector, each row of the terminals having a power terminal and a differential pair;

wherein the contacting portion of the power terminal in the upper row and the corresponding contacting portion of the power terminal in the lower row mechanically contact with each other to form parallel electrical paths.

2. The electrical connector as claimed in claim 1, wherein the electrical connector is fixed on a printed circuit board, front end of the power terminal in each row is regarded as a free end of the contacting portion, rear end of the power terminal is regarded as a soldering leg, the soldering leg of the power terminal is inserted and retained on the printed circuit board and electrically connected with a power point of the printed circuit board, the free ends of the two corresponding power terminals in two rows mechanically contact with each other.

3. The electrical connector as claimed in claim 2, wherein the free end of the contacting portion of the power terminal in the upper row bends downwardly to form a first bending portion and then forwardly and horizontally extending to form a first extending portion, the free end of the contacting portion of the power terminal in the lower row bends upwardly to form a second bending portion and then forwardly and horizontally extending to form a second extending portion, the first extending portion and the second extending portion contact with each other.

4. The electrical connector as claimed in claim 3, wherein the terminal module has a plurality of upper slots and lower slots, the contacting portions are respectively received in the upper slots and lower slots, the upper slot for receiving the power terminal in the upper row has a hole recessed from an inner surface thereof to correspond to the free end of the contacting portion of the power terminal in the upper row, the lower slot for receiving the power terminal in the lower row has a hole recessed from an inner surface to correspond to the free end of the contacting portion of the power terminal in the lower row, the hole in the upper slot and the hole in the lower slot communicate with each other, the first and second extending portions respectively run into corresponding holes to contact with each other.

5. The electrical connector as claimed in claim 4, wherein the terminal module has a base portion in a rear side and a mating portion in a front side, the mating portion has two opposite surfaces, the upper slots and lower slots are respectively disposed at the two opposite surfaces.

6. The electrical connector as claimed in claim 5, wherein the electrical connector has a shielding plate disposed in the mating portion, the shielding plate is sandwiched between the upper slots and the lower slots, the shielding plate has a notch corresponding to the holes to form a room in which the first extending portion and the second extending portion dispose and mechanically contact with each other.

7. The electrical connector as claimed in claim 5, wherein the mating portion has a stepping portion adjacent to the base portion, the electrical connector has a grounding member disposed at two opposite faces of the stepping portion, the terminal has a middle portion embedded in the stepping portion, the soldering leg extending out of the base portion.

8. The electrical connector as claimed in claim 1, wherein the differential pair is adjacent to the power terminal in each row, and the plurality of terminals comprise a grounding terminal in each row.

9. The electrical connector as claimed in claim 1, wherein the plurality of terminals are insert molded with the terminal module.

10. The electrical connector as claimed in claim 5, wherein the electrical connector has a metallic shell retained on an outer surface of the base portion and surrounding the mating portion and the stepping portion to form a mating cavity.

11. An electrical connector comprising:

a terminal module having two opposite mating faces;

an upper row of terminals retained in the terminal module and exposed upon one of the mating faces; and a lower row of terminals retained in the terminal module and exposed upon the other mating face;

wherein the upper and lower rows of terminals each comprise a power terminal and a differential pair adjacent to the power terminal, and the power terminal in the upper row mechanically contact with the power terminal in the lower row.

12. The electrical connector as claimed in claim 11, wherein each power terminal defined in upper and lower rows has a contacting portion and a leg portion, the contacting portion of the power terminal in the upper row and the corresponding contacting portion of the power terminal in the lower row mechanically contact with each other.

13. An electrical connector for mounting to a printed circuit board, comprising:

a terminal module including:

a mating tongue defining opposite upper surface and lower surface in a vertical direction;

a plurality of upper contacts each having an upper contacting section exposed on the upper surface, and an upper mounting leg for mounting to the printed circuit board, said upper contacts being categorized with upper power contacts, upper differential pair contacts neighboring the corresponding upper power contact in a transverse direction perpendicular to said vertical direction, and upper grounding contacts; and a plurality of lower contacts each having a lower contacting section exposed upon the lower surface, and a lower mounting leg for mounting to the printed circuit board, said lower contacts being categorized with lower power contacts, lower differential pair contacts neighboring the corresponding lower power contact in the transverse direction, and lower grounding contacts; wherein the upper contacting section of one upper power contact is aligned with the lower contacting section of the corresponding one lower power contact in the vertical direction;

at least one of said upper contacting section of said one upper power contact and the lower contacting section of said corresponding one lower power contact, extends, with an extending portion, toward and contacts the other of said upper contacting section of said one upper power contact and the lower contacting section of said corresponding one lower power contact in the vertical direction.

14. The electrical connector as claimed in claim 13, further including a metallic shielding plate embedded within the mating tongue between the upper surface and the lower surface, wherein said shielding plate forms a notch to receive said extending portion.

15. The electrical connector as claimed in claim 14, wherein the upper contacts are embedded within an upper insulator, the lower contacts are embedded within a lower insulator to cooperate with the upper insulator to sandwich the shielding plate therebetween in the vertical direction, an over-molding portion covering both said upper insulator and said lower insulator, and said extending portion extends beyond the corresponding one of said upper insulator and said lower insulator while covered by said over-molding portion.

16. The electrical connector as claimed in claim 15, wherein both said upper contacting section of said one upper power contact and said lower contacting section of said corresponding one lower power contact have the corresponding extending portions, respectively, and encountered with each other in the notch of said shielding plate.

17. The electrical connector as claimed in claim 13, wherein said extending portion is located around a front end of the corresponding contacting section.

* * * * *